United States Patent [19]

Romine

[11] Patent Number: 4,471,988

[45] Date of Patent: Sep. 18, 1984

[54] CUTTER BLADE HOLDER

[75] Inventor: Donnie O. Romine, Rogersville, Ala.

[73] Assignee: Champion International Corporation, Stamford, Conn.

[21] Appl. No.: 413,605

[22] Filed: Sep. 1, 1982

[51] Int. Cl.[3] ..... B65D 71/00

[52] U.S. Cl. ..... 294/158; 206/303; 294/159

[58] Field of Search ..... 294/137, 142, 143, 146, 294/158–163, 27 R, 87 R; 206/397, 445, 493, 511, 512, 303; 211/40, 41, 60 T, 123

[56] References Cited

U.S. PATENT DOCUMENTS

| | | | |
|---|---|---|---|
| 2,660,328 | 11/1953 | Averill | 206/511 X |
| 3,053,424 | 9/1962 | Reinhard | 294/163 |
| 3,302,800 | 2/1967 | Zdanowski | 211/123 |
| 3,477,584 | 11/1969 | Maslow et al. | 211/40 |
| 4,355,974 | 10/1982 | Lee | 211/40 X |
| 4,415,080 | 11/1983 | Romine et al. | 211/40 X |

FOREIGN PATENT DOCUMENTS

| | | | |
|---|---|---|---|
| 675994 | 12/1963 | Canada | 294/165 |

*Primary Examiner*—Johnny D. Cherry
*Attorney, Agent, or Firm*—Evelyn M. Sommer; William W. Jones

[57] ABSTRACT

A light weight holder for cutter blades of the type having a central mounting hub. The holder is formed from wire and includes an outer frame which protects the cutter blades from damage. A plurality of braces are connected to the frame with the braces also being connected to a central cutter blade hub-engaging cylindrical support member. The support member is notched so that the blades cannot shift axially thereof. A carrying handle is secured to the frame and support brackets are also mounted on the frame so that the holders can be securely stacked on top of each other to store the blades safely.

2 Claims, 3 Drawing Figures

CUTTER BLADE HOLDER

This invention relates to a cutter blade holder for transporting and storing hubbed cutter blades, and more particularly to a light weight holder made from wire.

Care must be taken in the handling, transporting and storage of circular cutter blades so that their cutting edges are not damaged. Cutter blades have been stored and transported in the past in such devices as sleeves, cylindrical cases, tool boxes, or simply out in the open or in fixed storage racks.

This invention is directed to a light weight storage and carrying rack for cutter blades wherein the blades are protected from damage, such as nicking of the cutting edge, from external sources and from each other. The carrier is of simple construction, being made preferably from wire, and includes an elongated blade carrier disposed centrally of a wire frame. A carrying handle is included, as are stacking brackets which allow a plurality of the carriers to be stacked atop one another for storage purposes.

It is therefore, an object of this invention to provide a carrier for hubbed cutter blades, which carrier can be used for transporting and storing the cutter blades.

It is a further object of this invention to provide a carrier of the character described which is light weight and includes a wire frame and a central elongated cutter blade hub-engaging portion.

It is yet another object of this invention to provide a carrier of the character described which includes a plurality of brackets mounted thereon to facilitate stacking of the carriers on top of each other for storage purposes.

These and other objects and advantages of the invention will become more readily apparent from the following detailed description of a preferred embodiment of the carrier when taken in conjunction with the accompanying drawings, in which.

Figure 1:
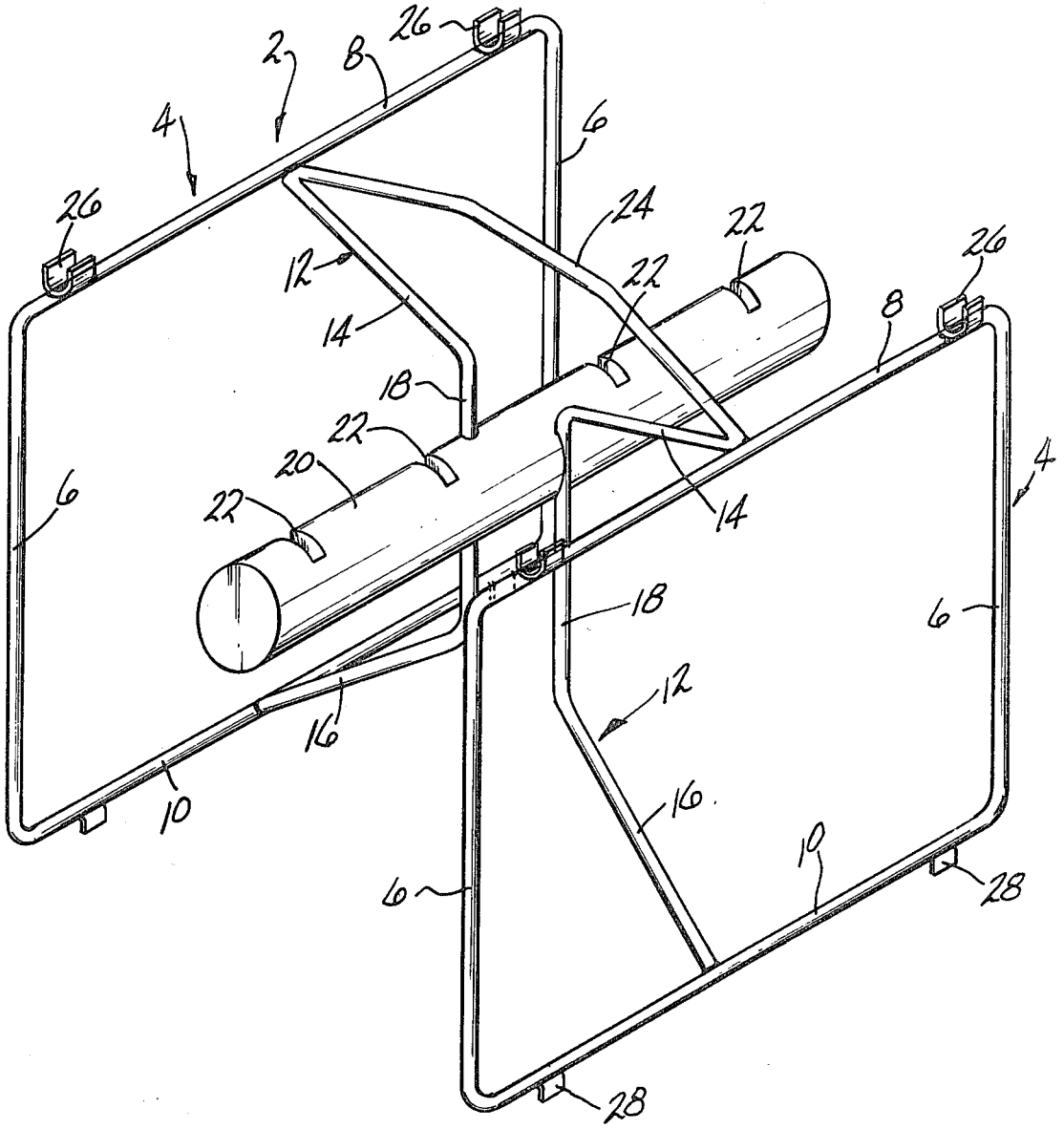
FIG. 1 is a perspective view of a preferred embodiment of a carrier formed in accordance with this invention.
Figure 2:
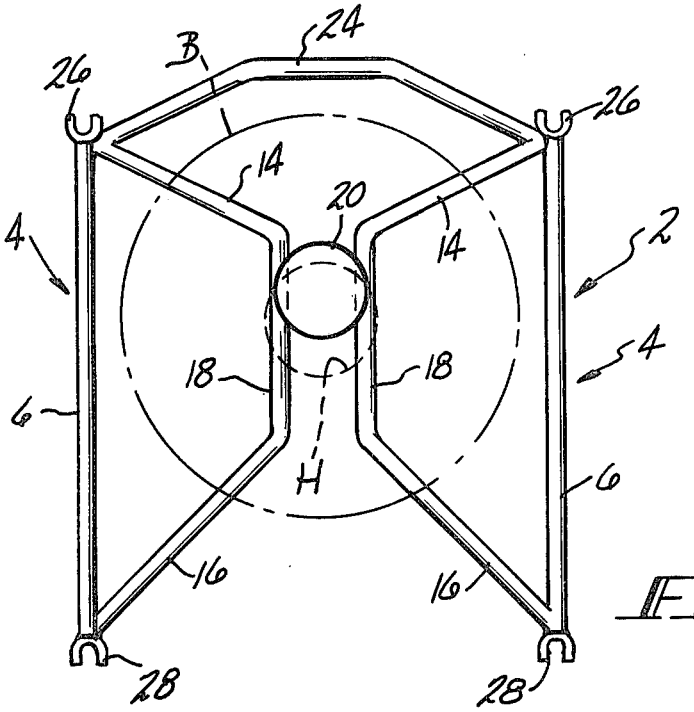
FIG. 2 is an end elevation of the carrier of FIG. 1 with the cutter blades being shown mounted thereon in phantom lines.
Figure 3:
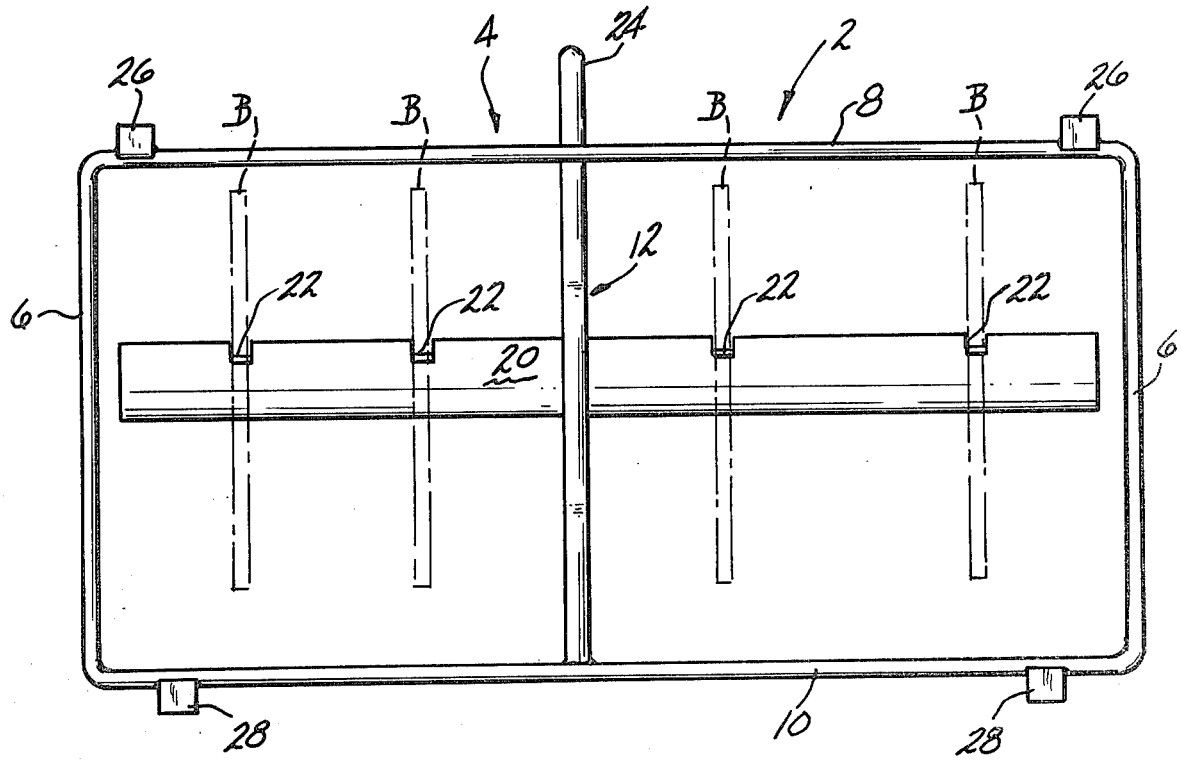
FIG. 3 is a side elevation of the carrier of FIGS. 1 and 2.

Referring now to the drawings, it will be noted that the carrier, designated generally by the numeral 2, includes a pair of substantially rectangular side frame members 4 each of which includes front and back legs 6, a top portion 8, and a bottom portion 10. A pair of internal bracing members 12 are secured to the side frame members 4 each bracing member 12 including an upper downwardly and inwardly extending portion 14, a lower upwardly and inwardly extending portion 16, and a medial vertically extending portion 18. A central elongated blade support member 20 is fixed to the medial portions 18 of the bracing members 12 and extends parallel to the planes of the side frame members 4 in the central portion of the carrier 2. The support member 20 is provided with a plurality of notches 22 into which the individual blades nest so as to prevent longitudinal movement of the blades over the support member 20. The notches 22 thus positively position the blades in the carrier 2 to protect the blades against damage which could be caused were they to contact each other. In FIGS. 2 and 3, the blades B are shown in phantom lines with their central hubs being designated as the letter H.

The carrier 2 also includes a handle 24 which extends between the top portions 8 of the side frame members 4. The top and bottom portions 8 and 10 of the side frame members 4 are each provided with a pair of U-shaped brackets 26 and 28 respectively. The upper brackets 26 are disposed closer to the front and back legs 6 than are the lower brackets 28 so that both brackets 26 and 28 will fit over the lower and upper portions 10 and 8 of carriers which are stacked one on top of the other. Thus the carriers stacked on top of each other will have interlocking supports and will be prevented from sliding forward or backward with respect to each other. As can be seen from FIGS. 2 and 3, the blades B carried by the carrier 2 have their outer cutting edges protected from impact by the side frames members 4 so that the likelihood of damage occurring to the blades B is significantly reduced.

It will be readily appreciated that the carrier of this invention is light weight, relatively simple and inexpensive to manufacture, and yet provides fully adequate protection for the blades when carried or stored in the carrier.

Since many changes and variations of the disclosed embodiment of the invention may be made without departing from the inventive concept, it is not intended to limit the invention otherwise than as required by the appended claims.

What is claimed is:

1. A cutter blade holder comprising:

(a) a pair of outer rectangular frame members formed from wire and each including top, bottom, front and back portions, said frame members being disposed in spaced apart parallel planes;

(b) a pair of bracing members formed from wire, one of said bracing members extending between and being secured to medial parts of the top and bottom portions of one of said frame members, and the other of said bracing members extending between and being secured to medial parts of the top and bottom portions of the other of said frame members, said bracing members including central portions which converge toward each other;

(c) handle means extending between and secured to the top portions of each of said frame members;

(d) an elongated cylindrical blade supporting member having an axis of elongation parallel to the planes of said frame members, said blade supporting member being disposed between and secured to said central portions of said bracing members, and said blade supporting member having opposite unimpeded end portions disposed on either side of said bracing members, which opposite end portions are operable to receive hubs of circular blades in telescoping fashion; and (e) said blade supporting member being provided with a plurality of axially spaced transverse notches disposed serially therealong on each side of said bracing members, said notches being operable to receive and engage hubs of circular blades telescoped onto said blade supporting member to prevent the blades from moving longitudinally of said blade supporting member.

2. The cutter blade holder of claim 1 further comprising inverted U-shaped brackets secured to said top and/or bottom portions of said frame members to provide open-ended means for interlocking engagement between two of said blade holders stacked one atop the other.

* * * * *